US006526770B1

(12) United States Patent
Tang et al.

(10) Patent No.: US 6,526,770 B1
(45) Date of Patent: Mar. 4, 2003

(54) METHOD FOR CONTROLLING THE TEMPERATURE OF A REFRIGERATOR

(75) Inventors: Haibei Tang, Qingdao (CN); Baozhong Li, Qingdao (CN); Zhiping Li, Qingdao (CN); Wei Wei, Qingdao (CN)

(73) Assignees: Haier Group Corporation, Qingdao (CN); Qingdao Haier Refrigerator Co., Ltd., Qingdao (CN)

( * ) Notice: Subject to any disclaimer, the term of this patent is extended or adjusted under 35 U.S.C. 154(b) by 0 days.

(21) Appl. No.: 09/661,100

(22) Filed: Sep. 13, 2000

(30) Foreign Application Priority Data

Sep. 14, 1999 (CN) ..... 99112442 A

(51) Int. Cl.[7] ..... F25B 49/02
(52) U.S. Cl. ..... 62/209; 62/229
(58) Field of Search ..... 62/229, 208, 209; 236/91 R, 91 A, 91 D

(56) References Cited

U.S. PATENT DOCUMENTS 4,089,462 A * 5/1978 Bradford ..... 236/91 R X
4,289,272 A * 9/1981 Murase et al. ..... 236/91 D
4,495,780 A * 1/1985 Kaneko et al. ..... 62/209 X
5,293,755 A * 3/1994 Thomas ..... 62/208
5,524,447 A * 6/1996 Shim ..... 62/209

* cited by examiner

*Primary Examiner*—Harry B. Tanner

(57) ABSTRACT

The present invention relates to temperature control for refrigerators, which automatically adjusts the on-temp/off-temp values in view of the fluctuation of the ambient temperature. The present invention also relates to a refrigerator on which a sensor of simplified circuit design is reasonably allocated. In accordance with the present invention, ambient temperature is divided into a plurality of particular temperature divisions, the on-temp and off-temp values preferred for refrigerator operation in each corresponding temperature division are determined by experiments. By means of a temperature sensor, on-temp/off-temp values appropriately corresponding to a particular temperature division are applied to keep the temperature of the refrigerator at a required level.

6 Claims, 3 Drawing Sheets

METHOD FOR CONTROLLING THE TEMPERATURE OF A REFRIGERATOR

TECHNICAL FIELD

The present invention generally relates to appliance and, more particularly, to refrigerators and temperature control for the same.

BACKGROUND

Up to the present invention, temperature control for refrigerators was done manually. Once the temperature settings of a regulator or computer panel for refrigerators' temperature control has been determined, temperature values for turning the refrigerator on/off are fixed. The values remain unchanged no matter the ambient temperature has changed. It would be fine in a situation that the ambient temperature is changed in a narrow range. However, if the ambient temperature changes significantly, the fixed values may not keep the temperature in the refrigerator at a required level. As a result, the food in the refrigerator becomes either defrozen as the temperature in the refrigerator is too high or over frozen as the temperature in the refrigerator is too low. Either of both eases is adverse for food reservation.

DESCRIPTION

One objective of the present invention is to provide a temperature control for refrigerators, which may automatically regulate values for turning the refrigerator on/off as the ambient temperature varies.

Another objective of the present invention is to provide a simply designed refrigerator with a reasonably allocated environment sensor.

In accordance with the present invention, a method for temperature control comprises steps of defining at least a first temperature division and a second temperature division of ambient temperature and determining first on-temp/off-temp values for turning on/off the refrigerator in said first temperature division and second on-temp/off-temp values for turning on/off the refrigerator in said second temperature division; detecting and transferring ambient temperature signals to a control processor; enabling the on-temp/off-temp values by the control processor in response to received ambient temperature signals; determining in response to the ambient temperature signals whether variation of the ambient temperature is within the first temperature division and adjusting the first on-temp/off-temp values to the second on-temp/off-temp values if the ambient temperature changes from the first temperature division to the second temperature division.

In accordance with the present invention, the on values corresponding to a plurality of temperature divisions are consistent while the off-temp values are changed. Furthermore, a plurality of temperature division has correspondent on-temp/off-temp values as follows:

| Temperature Division ° C. | On-Temp Value ° C. | Off-Temp Value ° C. |
|---|---|---|
| [−60, −2) | 4 | −25 ~ −30 |
| [−2, 5) | 4 | −21 ~ −26 |
| [5, 14) | 4 | −19 ~ −23 |
| [14, 21) | 4 | −18 ~ −21 |

-continued

| Temperature Division ° C. | On-Temp Value ° C. | Off-Temp Value ° C. |
|---|---|---|
| [21, 28) | 4 | −17 ~ −19 |
| [28, 36) | 4 | −16 ~ −18 |
| [36, +60) | 4 | −15 ~ −17 |

The present invention provides a refrigerator comprising a shell and a control processor. A sensor is set up at the rear top of the shell, in particular, a position for separating the cooling source from the heating source. The sensor is coupled to the input of the control processor which outputs are coupled to a heater and a compressor respectively.

In accordance with the present invention, the sensor is connected to a power supply through a resistor and to the input of the control processor through a capacitor The sensor is grounded directly. The input of the control processor is connected to the power supply through a resistor and a capacitor.

Furthermore, the heater is connected across the power supply and in series with the normal-on switch of a relay that is connected in parallel with a diode. The output of the control processor is connected to the base of a transistor through a resistor. The emitter of the transistor is grounded while the collector of the transistor is connected to the power supply.

Moreover, the compressor is connected across the power supply and in series with the normal-on switch of the relay that is connected in parallel with a diode. The output of control processor is connected to the base of the transistor. The emitter of the transistor is grounded while the collector of the transistor is connected to the power supply.

The advantages and essential effects of the invention are that with location of the sensor in the rear shell top of ale refrigerator, neither cooling source nor heating source all around, thereby minimizing the disturbance to the operation of the sensor. In accordance with a preferred embodiment of the present invention, a particular temperature division is determined [21, 28) at ambient temperature of 25° C. so the on-temp value should be 4° C. and the off-temp value −18° C. With these on-temp and off-temp values in this particular division, the temperature of the storage compartment in the refrigerator is maintained within a range of 4° C.~7° C. while the temperature of the freezing compartment is stabilized under −18° C. When the ambient temperature fluctuates in 21° C.~28° C., the on-temp value is still +4° C. and the off-temp value of −18° C. remains unchanged, so the temperature in the refrigerator keeps unchanged also. When the ambient temperature drops to about +18° C., the sensor detects the current temperature and sends a detecting signal to the control processor that determines the current ambient temperature in the temperature division [14, 21), thereby automatically setting up the on-temp value at 4° C. and the off-temp value at −19° C. Accordingly, the refrigerator operates under such conditions, keeping the temperature in the refrigerator unchanged.

BRIEF ILLUSTRATION OF DRAWINGS

PREFERRED EMBODIMENTS

Figure 1:
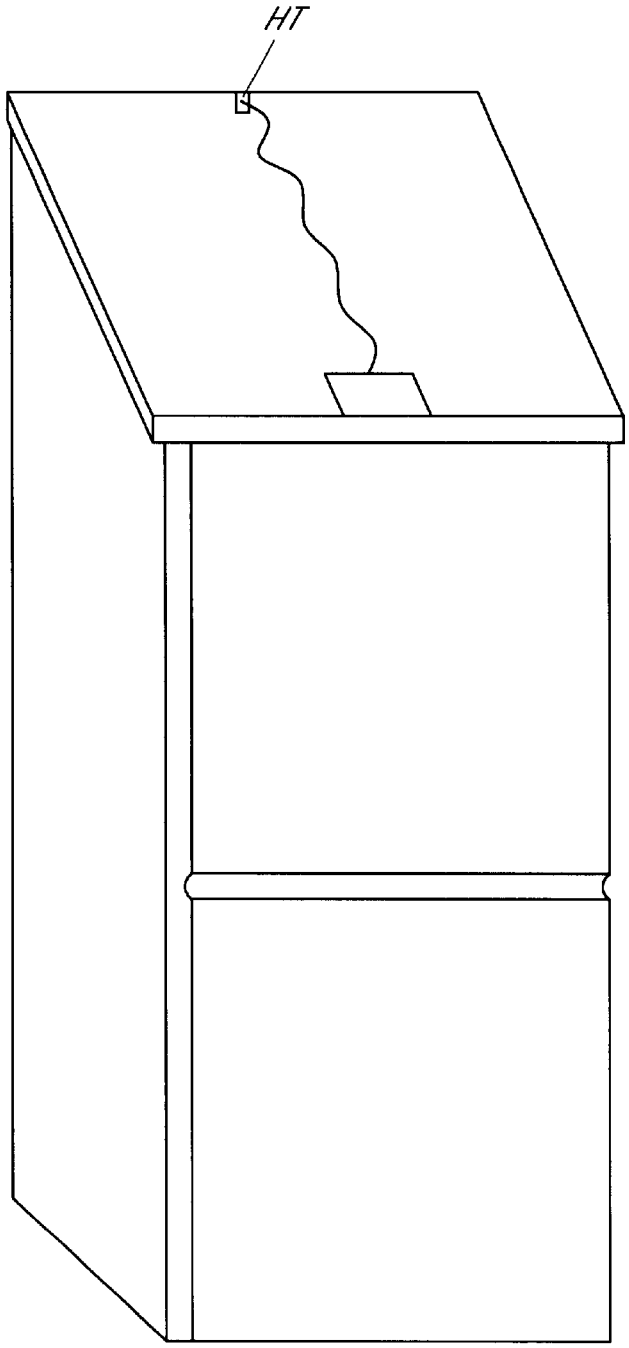
FIG. 1 shows the location of the sensor in accordance with the present invention.
Figure 2:
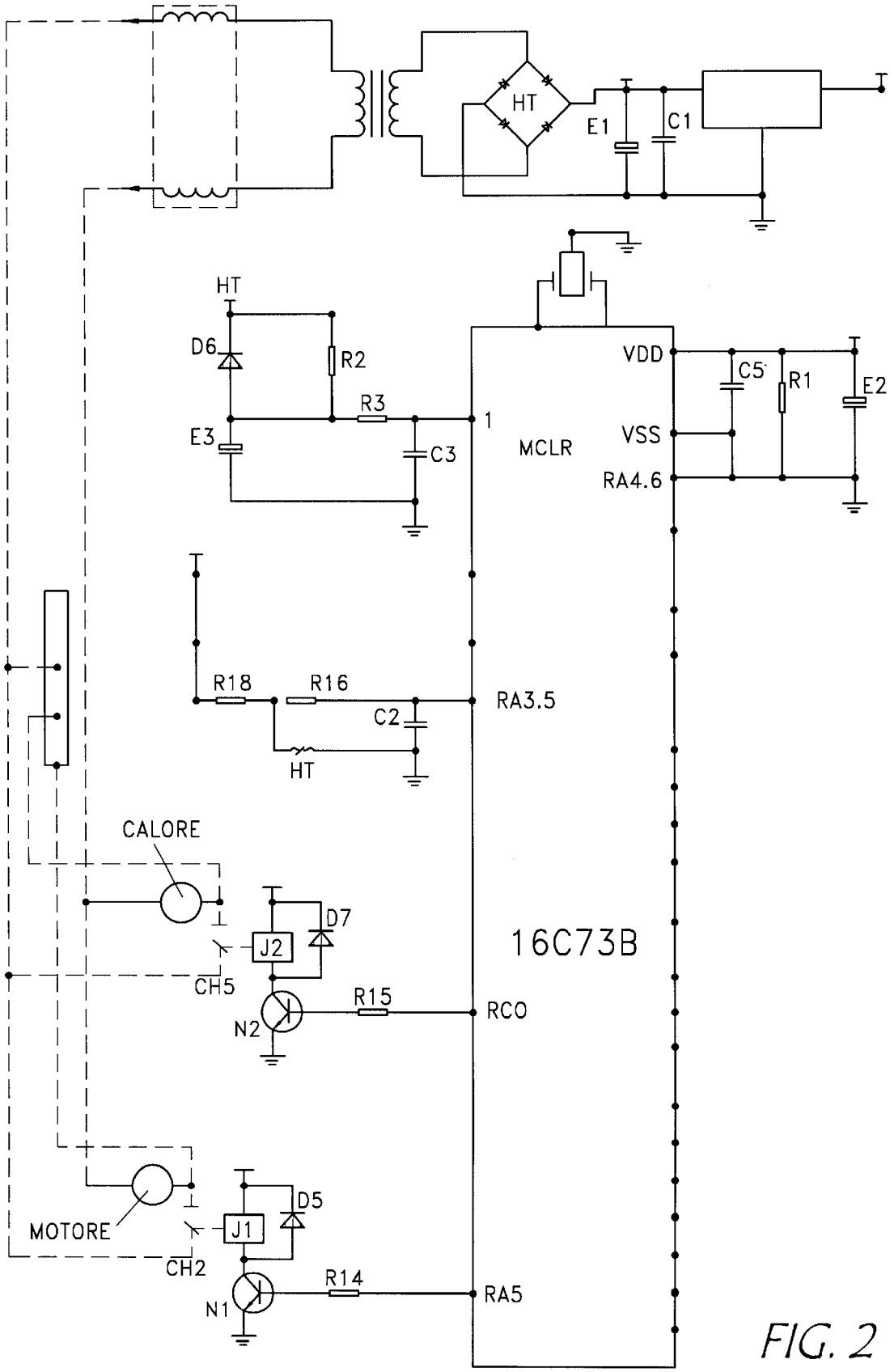
FIG. 2 is a circuit diagram of the sensor in accordance with the present invention.

As shown in FIG. 1 and FIG. 2, temperature control for refrigerators comprises following steps:

a) defining at least one first temperature division and one second temperature division of ambient temperature and determining first on-temp/off-temp values for turning on/off the refrigerator in said first temperature division and second on-temp/off-temp values for turning on/off the refrigerator in said second temperature division;

b) detecting and transferring ambient temperature signals to a control processor;

c) enabling the on-temp/off-temp values by the control processor in response to received ambient temperature signals;

d) determining in response to the ambient temperature signals whether variation of the ambient temperature is within the first temperature division and adjusting the first on-temp/off-temp values to the second on-temp/off-temp values if the ambient temperature changes from the first temperature division to the second temperature division.

In light of the reality of operation of a refrigerator, the on-temp value is normally consistence, so the on-temp values in accordance with the present invention remain constant while the off-temp values are appropriately varied corresponding to each of temperature divisions. Based upon experiments and practice, the data with respect to the particular temperature divisions and the on-temp and off-temp values corresponding to the respective temperatures are listed as follows:

| Temperature Division ° C. | On-Temp Value ° C. | Off-Temp Value ° C. |
|---|---|---|
| [−60, −2) | 4 | −30 |
| [−2, 5) | 4 | −25 |
| [5, 14) | 4 | −21 |
| [14, 21) | 4 | −19 |
| [21, 28) | 4 | −18 |
| [28, 36) | 4 | −17 |
| [36, +60) | 4 | −16 |

In accordance with the data listed above, the control processor is programmed to perform its control task.

Figure 3:
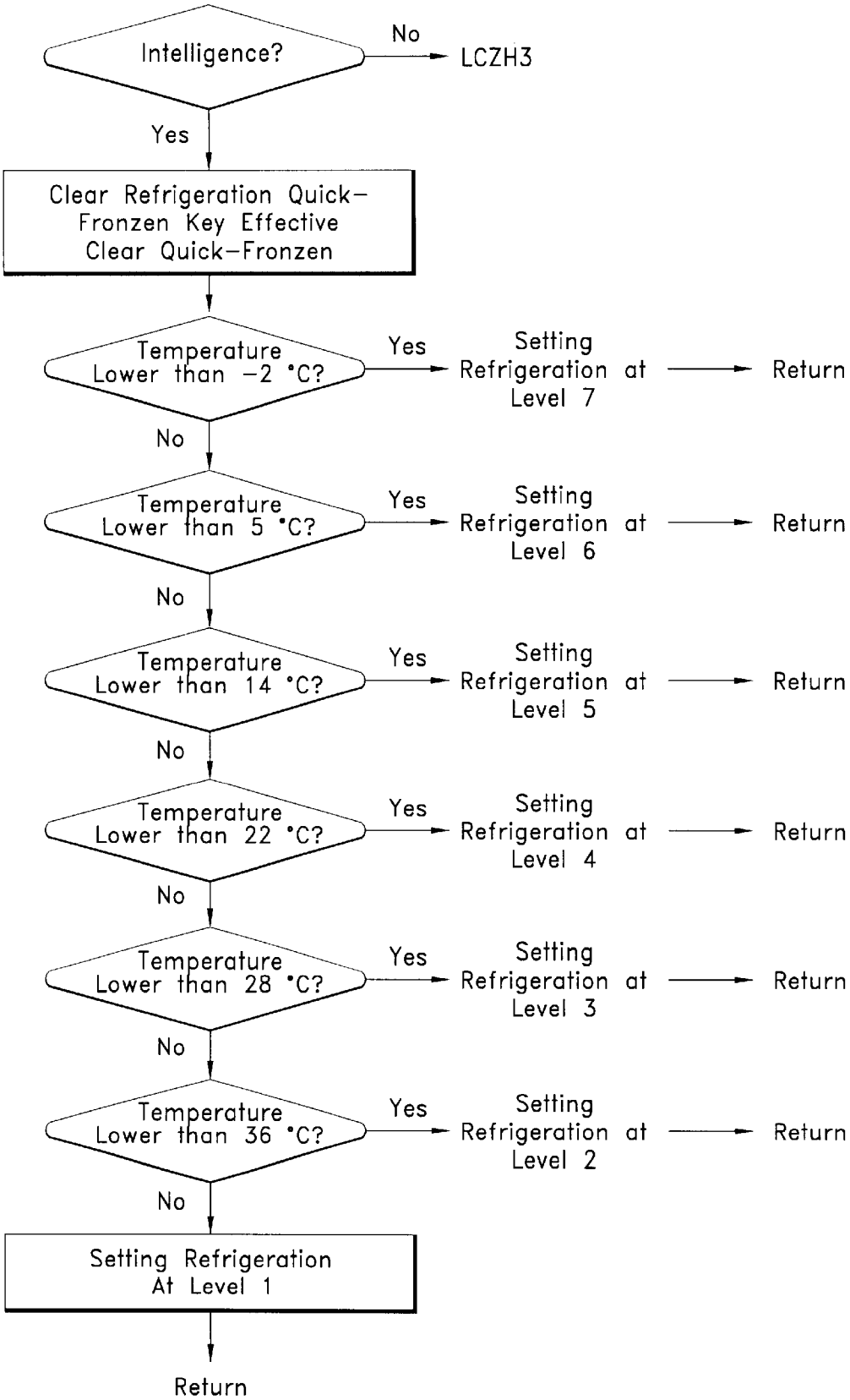
FIG. 3 is a block diagram of the program segment of the control processor in relation to the sensor.

FIG. 3 shows the flow chart of the control program. The code of the program is written by C-language and listed as follows:

```
LCZHHT      MOVLW   OAAU
            SUBWF   TXH, 0
            BTFSS   STATUS, 2
            GOTO    LCZH3
LCZHHT1     BCF     FLAG1, 1
            BCF     FLAG2, 2
            BCF     FLAG6, 2
            BCF     FLAG6, 3
            BCF     FLAG3, 3
            BCF     FLAG6, 6
            BCF     FLAG6, 7
            CLRF    SDT
            CLRF    SD
            MOVLW   OD2H
            SUBWF   HT, 0
            BTPSC   STATUS, 0
            GOTO    SETID
```

-continued

```
LCZHHT      MOVLW   OAAU
            BCF     FLAGA, 1
            ;; BTFSC FLAGA, 2
            ;; GOTO  ZhHT
            MQVLW   OC5H
            SUBWF   HT, 0
            BTFSC   STATUS, 0
            GOTO    SET2D
ZHHT5       BCF     FLAGA, 2
            ;; BTFSC FLAGA, 3
            ;; GOTO  ZHHT1
            MOVLW   OAFH.
            SUBWF   HT, 0
            BTFSC   STATUS, 0
            GOTO    SET3D
ZHHT6       BCF     FLAGA, 3
            ;; BTFSC FLAGA, 4
            ;; GOTO  ZHHT2
            MOVLW   099H
            SUBWF   HT, 0
            BTFSC   STATUS, 0
            GOTO    SET4D
            BCF     FLAGA, 4
            ;; BTFSC FLAGA, 5
            ;; GOTO  ZHHT3
            MOVLW   089H
            SUBWF   HT, 0
            BTFSC   STATUS, 0
            GOTO    SET5D
ZHHT8       BCF     FLAGA, 5
            ;; BTFSC FLAGA,6
            ;; GOTO  ZHHT4
            MOVLW   073H
            SUBWF   HT, 0
            BTFSC   STATUS, 0
            GOTO    SET6D
ZHHT9       CLRF    FLAGA
            BSF     FLAGA, 7
            MOVLW   001H
            MOVLW   SRT
            MOVLW   RD
            ; BCF   FLAG1, 3;;
            RETURN
SET1D       MOVLW   007H
            MOVWF   SRT
            MOVWF   RD
            CLRF    FLAGE
            BSF     FLAGE, 1
            RETURN
SET2D       MOVLW   006H
            MOVWF   SRT
            MOVWF   RD
            CLRF    FLAGE
            BSF     FLAGE, 2
            RETURN
SET3D       MOVLW   005H
            MOVWF   SRT
            MOVWF   RD
            CLRF    FLAGE
            BSF     FLAGE, 3
            RETURN
SET4D       MOVLW   004H
            MOVWF   SRT
            MOVWF   RD
            CLRF    FLAGE
            BSF     FLAGE, 3
            RETURN
SET5D       MOVLW   003H
            MOVWF   SRT
            MOVWF   RD
            CLRF    FLAGE
            BSF     FLAGE, 5
            RETURN
SET6D       MOVLW   002H
            MOVWF   SRT
            MOVWF   RD
```

-continued

| | | |
|---|---|---|
| LCZHHT | MOVLW | OAAU |
| | CLRF | FLAGE |
| | BSF | FLAGE, 6 |
| | RETURN | |

In order to utilize the temperature control, modification has to be made to regular refrigerators. A regular refrigerator has to have a shell and a processor that actually is a control chip sensor HT is set up at the rear shell top of the refrigerator where is a cooling source is separated from a heating source. The sensor is coupled to the input RA3.5 of the processor while tie output RC0 of the processor is connected to a heater and output RA5 to a compressor.

The processor is a 16C73B chip. Its pin 1 MCLR is grounded by capacitor C3 of 104F capacitance. Pin 1 also is connected to a resistor R3 of 1K resistance. Resistor R3 is connected to the power supply through a 10K resistor R2 and a diode D6. The power supply is grounded through a IN4003 reverse diode D6 and a 4.7 $\mu$F/16V capacitor E3. The processor has its VSS and RA4.6 connected in common to VDD through a 104F capacitor C5. The RA4.6 is also connected to VDD through a 2.2K resistor R1 and a 4.7 $\mu$F/16V capacitor E2. VDD end is connected to the power supply and RA4.6 end is grounded. The sensor that may be a regular temperature sensor is connected to the power supply through a 1.5K resistor R18. The sensor is also connected to the input PA3.5 of the processor through a 101F capacitor C2. The sensor is connected to ground directly. The input RA3.5 of the processor is connected to the power supply through a 2.2K resistor R16 and resistor R18.

The heater is in series connected to normal-on switch CH1 of the relay across the power supply. The power supply is provided by a transformer and a stabilizer after an external power is filtered by a 104F capacitor C1 and a 2200 U$\mu$F/25V capacitor E1 and rectified by a bridge rectifying circuit. The output RCO of the processor is connected to the base of a S9014 type transistor N2 through a 4.7K resistor R15. The emitter of the transistor N2 is grounded while the collector is connected to the power supply through relay J2 that is in parallel connected to an IN4003 type diode D7.

The compressor is in series connected to the normal-on switch CH2 of the relay across the power supply. The output RA5 of the processor is connected to the base of S9014 type transistor N1 through a 4.7K resistor R14. The emitter of the transistor N1 is grounded while the collector is connected to the power supply through a relay J1 that is in parallel connected with an IN4003 diode D5.

What is claimed is:

1. A method for controlling temperature of a refrigerator comprising:

defining a plurality of temperature divisions including at least a first temperature division and a second temperature division of ambient temperature, each division including upper and lower temperature values, and determining first on-temp/off-temp values for turning on/off the refrigerator in the first temperature division and second on-temp/off-temp values for turning on/off the refrigerator in the second temperature division;

detecting ambient temperature and transferring signals indicative of the ambient temperature to a control processor;

enabling the on-temp/off-temp values by the control processor in response to the ambient temperature signals; and determining in response to the ambient temperature signals whether the ambient temperature is within the first temperature division and adjusting the first on-temp/off-temp values to the second on-temp/off-temp values if the ambient temperature changes from the first temperature division to the second temperature division.

2. A method as recited in claim 1, wherein the on-temp values remain unchanged while the off-temp values vary in response to each of temperature divisions.

3. The method as recited in claim 1, wherein the on-temp/off-temp values corresponding to each of the plurality of temperature divisions are listed as follows:

| Temperature Division ° C. | On-Temp Value ° C. | Off-Temp Value ° C. |
|---|---|---|
| [−60, −2) | 4 | −25 ~ −30 |
| [−2, 5) | 4 | −21 ~ −26 |
| [5, 14) | 4 | −19 ~ −23 |
| [14, 21) | 4 | −18 ~ −21 |
| [21, 28) | 4 | −17 ~ −19 |
| [28, 36) | 4 | −16 ~ −18 |
| [36, +60) | 4 | −15 ~ −17. |

4. The method as recited in claim 2, wherein the on-temp/off-temp values corresponding to each of the plurality of temperature divisions are listed as follows:

| Temperature Division ° C. | On-Temp Value ° C. | Off-Temp Value ° C. |
|---|---|---|
| [−60, −2) | 4 | −25 ~ −30 |
| [−2, 5) | 4 | −21 ~ −26 |
| [5, 14) | 4 | .19 ~ −23 |
| [14, 21) | 4 | −18 ~ −21 |
| [21, 28) | 4 | −17 ~ −19 |
| [28, 36) | 4 | −16 ~ −18 |
| [36, +60) | 4 | −15 ~ −17. |

5. A method for controlling temperature of a refrigerator comprising:

defining at least a first temperature division and a second temperature division of ambient temperature, and determining first on-temp/off-temp values for turning on/off the refrigerator in the first temperature division and second on-temp/off-temp values for turning on/off the refrigerator in thee second temperature division;

detecting ambient temperature and transferring signals indicative of the ambient temperature to a control processor;

enabling the on-temp/off-temp values by the control processor in response to the ambient temperature signals; and determining in response to the ambient temperature signals whether the ambient temperature is within the first temperature division and adjusting the first on-temp/off-temp values to the second on-temp/off-temp values if the ambient temperature changes from the first temperature division to the second temperature division, wherein the on-temp values remain unchanged while the off-temp values vary in response to each of the temperature divisions.

6. A method for controlling temperature of a refrigerator comprising:

defining a plurality of temperature divisions including at least a first temperature division and a second temperature division of ambient temperature, and determining first on-temp/off-temp values for turning on/off the refrigerator in the first temperature division and second on-temp/off-temp values for turning on/off the refrigerator in the second temperature division;

detecting ambient temperature and transferring signals indicative of the ambient temperature to a control processor;

enabling the on-temp/off-temp values by the control processor in response to the ambient temperature signals; and determining in response to the ambient temperature signals whether the ambient temperature is within the first temperature division and adjusting the first on-temp/off-temp values to the second on-temp/off-temp values if the ambient temperature changes from the first temperature division to the second temperature division, wherein the on-temp/off-temp values corresponding to each of the plurality of temperature divisions are listed as follows:

| Temperature Division ° C. | On-Temp Value ° C. | Off-Temp Value ° C. |
|---|---|---|
| [−60, −2) | 4 | −25 ~ −30 |
| [−2, 5) | 4 | −21 ~ −26 |
| [5, 14) | 4 | .19 ~ −23 |
| [14, 21) | 4 | −18 ~ −21 |
| [21, 28) | 4 | −17 ~ −19 |
| [28, 36) | 4 | −16 ~ −18 |
| [36, +60) | 4 | −15 ~ −17. |

* * * * *